United States Patent [19]

Annacker

[11] Patent Number: 4,828,199

[45] Date of Patent: May 9, 1989

[54] PROCESS AND DEVICE FOR REMOVING RESIDUAL PARTS OF ROLLED COILS IN STRIP ROLLING MILLS

[75] Inventor: Heinz Annacker, Singen, Fed. Rep. of Germany

[73] Assignee: Swiss Aluminium Ltd., Chippis, Switzerland

[21] Appl. No.: 64,314

[22] Filed: Jun. 18, 1987

[30] Foreign Application Priority Data

Jun. 27, 1986 [DE] Fed. Rep. of Germany ..... 3621612

[51] Int. Cl.[4] ..... B21C 47/24; B65H 19/30

[52] U.S. Cl. ..... 242/79; 242/58.6

[58] Field of Search ..... 242/79, 58.6, 56 R, 242/78.6, 78.7, 80; 414/911, 281, 592

[56] References Cited

U.S. PATENT DOCUMENTS

| | | | |
|---|---|---|---|
| 2,464,464 | 3/1949 | Schefe | 242/79 |
| 2,527,667 | 10/1950 | Wood | 242/79 |
| 2,734,405 | 2/1956 | Cozzo | 242/79 |
| 3,393,881 | 7/1968 | Nash | 242/79 |

*Primary Examiner*—Stuart S. Levy
*Assistant Examiner*—Steven M. duBois
*Attorney, Agent, or Firm*—Bachman & LaPointe

[57] ABSTRACT

The invention relates to a process for removing the residual part of coils from a sheet or strip rolling mill in which the coils to be rolled are transported from the coil store to the uncoiling reel in a two-stroke process by means of a transportation facility e.g. coil transportation vehicle, horizontally and in a shuttle-like manner in the mill pit, the first stroke i.e. stage I being the movement of the coil transporter from the coil store to the uncoiling reel, and stage II being the movement of the coil transporter from the uncoiling reel back to the coil store. During a first stage of the process a new coil (7) is taken from the coil store (8) by the coil transporter (4) and driven to the region near the uncoiling reel (2), at the same time the residual part of the rolled coil (3) is removed from the uncoiling reel (2) by means of a trough (6) working in conjunction with the coil transporter (4) and the new coil to be rolled installed by advancing the coil transporter (4) into the region of the uncoiling reel (2) and mounted on this in preparation for threading into the rolls, while in a second process stroke, stage II, the coil transporter (4) and also the trough (6) for receiving a new coil (7) and delivering the residual part of the rolled coil (3) move back to their starting position.

10 Claims, 2 Drawing Sheets

PROCESS AND DEVICE FOR REMOVING RESIDUAL PARTS OF ROLLED COILS IN STRIP ROLLING MILLS

BACKGROUND OF THE INVENTION

The invention relates to a process for removing the residual parts of coils in strip rolling plants, and also relates to a device for carrying out this process.

When rolling strip in single and multi-stand rolling mills it is necessary to interrupt the rolling process before the complete coil has been rolled, in order to be able to remove the residual part of the coil from the rolling unit.

This applies especially when rolling coils without spools where the residual part of the coil is damaged by the coil clamping facilities on the uncoiling reel and is therefore unsuitable for further rolling.

In practice the residual part of a coil is either removed directly from the unwinding reel by means of a crane fitted with clamping jaws or by means of a coil trolley with jacking facilities.

Other units are fitted with independent transportation facilities below ground level, which lower the residual part of the coil from the uncoiling station by means of a jacking facility. The residual part of the coil can then be transported by conveyor facilities to a suitable place for removal.

Such independent units for removal of the residual part of rolling coils, situated and operating outside the mill require a relatively large area and special safety measures. In addition, they are not suitable for retro-fitting existing rolling mills.

If the residual parts of the coils are removed using the vehicle for transporting the whole coils, then there is, unavoidably, an interruption in the rolling process, which interferes with the production sequence and the performance of the rolling mill.

The known independent facilities for residual coil removal situated below ground level do overcome the above mentioned disadvantages. They are however complicated and are therefore technically complex, for which reason they are found to require a great deal of maintenance and repair.

SUMMARY OF THE INVENTION

The object of the present invention is to overcome the above disadvantages and to design a process and device such that on the one hand the operating sequence of the rolling process is interrupted only briefly and on the other hand the technical means used for that purpose are simpler and consequently easier to maintain and operate. Furthermore, it should be mills using relatively simple means.

This object with respect to the process is achieved by way of the invention in that during a first stroke i.e. stage I of the process a new coil is taken from the coil store by a coil transporter and driven to the region near the uncoiling reel, at the same time the residual part of the rolled coil is removed from the uncoiling reel by means of a trough working in conjunction with the coil transportation vehicle and the new coil to be rolled installed by advancing the coil transportation vehicle into the region of the uncoiling reel and mounted on this in preparation for threading into the rolls. In a second process stroke, stage II, the coil transportation vehicle and also the trough for receiving a new coil and delivering the residual part of the rolled coil move back to their starting position.

According to a further feature of the present invention, it is advantageous if the horizontal movements of the coil transporter and the trough to receive the residual part of the coil are synchronous in distance and in time, and if the vertical movement of the coil engaging facility and the trough for holding the residual part of the coil constitutes a subsequent program.

Furthermore, the invention makes it possible to extensively automate the whole process sequence in such a way that the stopping of the rolling mill and the subsequent shearing of the sheet or strip as well as the threading or feeding-in of the sheet of strip of a new coil are controlled in coordination with the first stage in the process.

The manner of carrying out the process in accordance with the invention overcomes the numerous difficulties and disadvantages encountered up to now. It shortens in particular the non-production time of the mill by the smooth interaction of the various operations, especially the sequence of movements involved in the delivery of a new coil, the removal of the residual part of a coil and the feeding-in of the new coil. This is achieved by coordination of movement and timing.

The device for carrying out this manner of process is based on a known coil transportation device in the form of a coil transportation vehicle and is characterized by way of comprising essentially of a trough that can be raised and lowered, is for the residual part of the coil, is situated on the mill stand side of the coil transportation vehicle, and can be moved horizontally in synchrony with the latter both in terms of time and distance. Further advantageous features will be apparent hereinbelow.

BRIEF DESCRIPTION OF THE DRAWINGS

Further details and features of the invention are described more specifically in the following with the aid of an exemplified embodiment and the drawings wherein.

DETAILED DESCRIPTION

Figure 1:
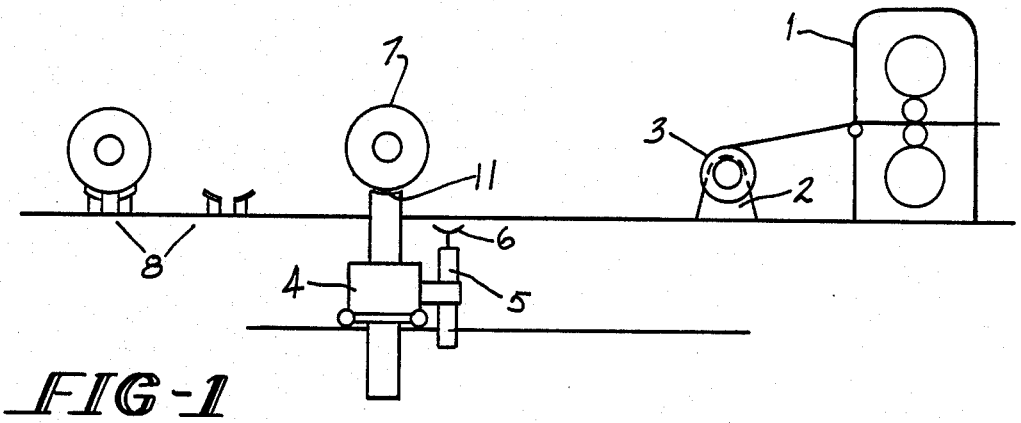
FIGS. 1–4 represent a schemtic representation of the entry side of a rolling mill showing an example of the device for removing the residual part of a coil, shown here in four consecutive stages of operation.

Shown in FIG. 1 is the first phase of the operation for removal of the residual part of a coil. On rolling mill 1, the rolling of coil 3 on uncoiling reel 2 is coming to an end. The coil transporter 4 with the device for removing the residual part of the coil mounted on it, including jacking device 5 and coil transportation trough 6 is in the process of transporting a new, yet to be rolled, coil 7 from the coil store 8 to the uncoiling reel.

Figure 2:
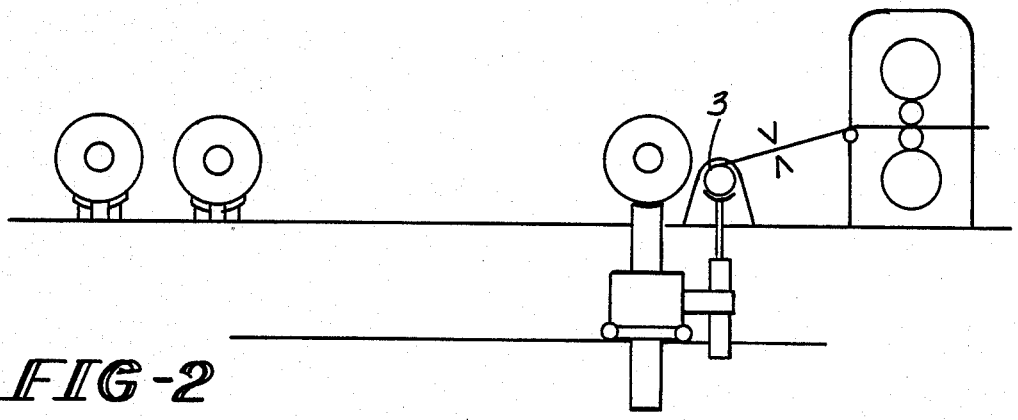

In FIG. 2 the whole mobile unit is standing at the uncoiling reel. This reel is stopped, the residual part 3 of the coil is supported by the trough 6 and the strip sheared as indicated.

Figure 3:
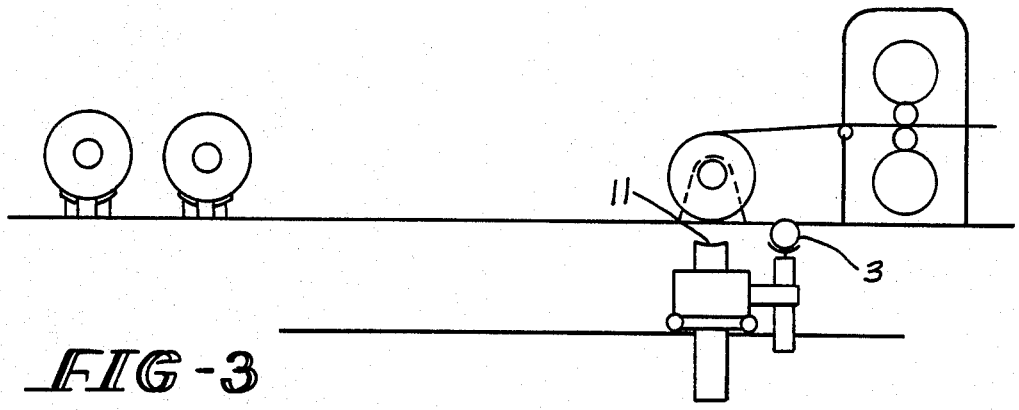

FIG. 3 shows the new coil 7 to be rolled mounted on the uncoiling reel 2 and the strip fed into the rolling mill 1; at the same time the coil transportation vehicle 4 with the residual coil removing device 5, 6 and the residual part of the coil 3 has started its return movement in the direction of the coil store 8.

Figure 4:
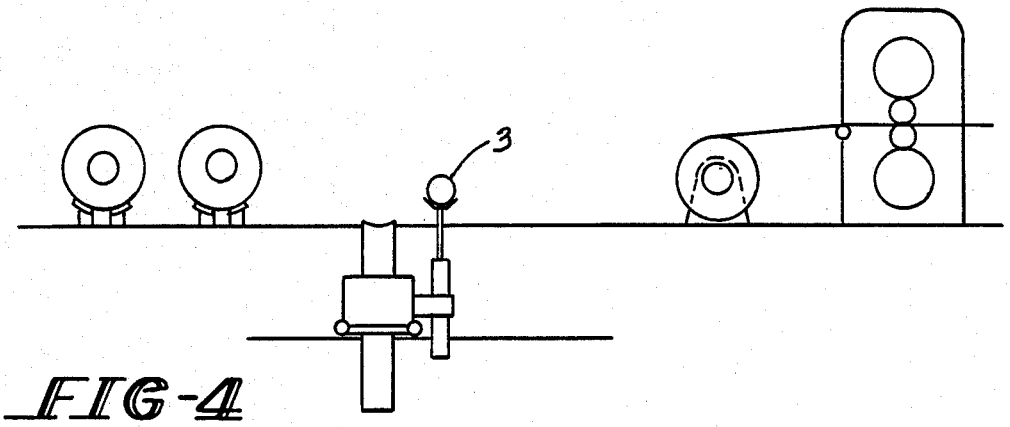

FIG. 4 shows the last phase of the process: the coil transportation vehicle 4 stops briefly at a particular point; and the jacking facility 5 raises the residual part of the coil 3 to the position at which it can be removed quickly and without difficulty. Finally the coil transporter 4 moves to the left and takes the next coil 7 to be rolled from the coil store 8. The process is repeated further in the manner described.

Figure 5:
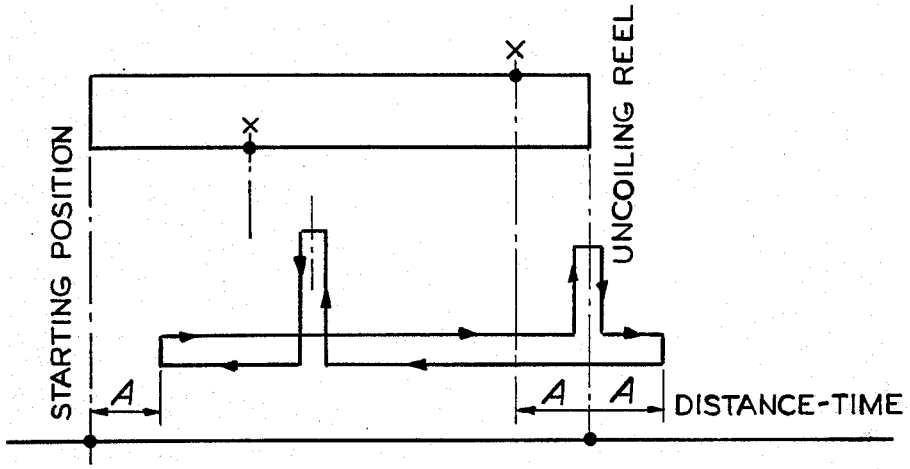
FIG. 5 represents a diagrammatic example of the sequence of movements of a coil transportation vehicle and the corresponding movements of the device for removing the residual part of a coil.

FIG. 5 illustrates by way of example the movements made by coil transporter and the device for removing the residual part of the coil.

The upper diagram shows the sequence of movements experienced by a point for example on the coil transporter 4; the lower diagram represents the movements experienced by a point on the jacking facility 5 of the device for removing the residual part of a coil. The distance A corresponds to the span of the distance between the axles on the coil transporter and the device.

The points indicated by the crosses indicate the positions "removal of coil residue" and "depositing the coil residue".

Figure 6:
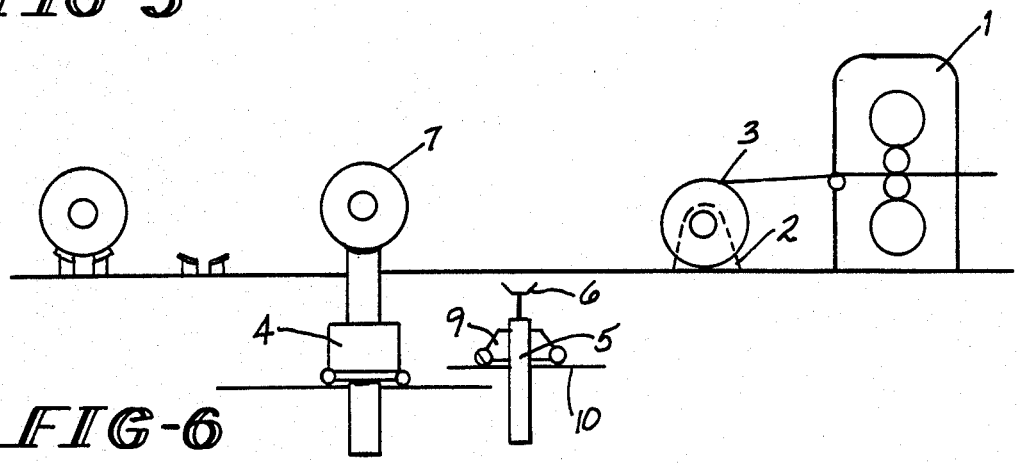
FIG. 6 represents an example of an independently driven device according to the invention for removal of the residual part of a coil.

Shown in FIG. 6 is an example of another version of the invention. There the device for removing the residual part of a coil features a vehicle 9 that can run on rails 10. As a result it can move independent of the coil transporter 4. The horizontal and vertical movements of both units are appropriately synchronized.

This form of the invention makes it possible to retrofit rolling plants that are equipped with another kind of coil transporter.

What is claimed is:

1. Process for removing a residual part of a rolled coil from and for installing a new coil on a sheet or strip rolling mill in which the new coil to be rolled is transported in a two-stroke process and in a shuttle-like manner, wherein a first stroke of the two-stroke process forms a Stage I and a second stroke of the two-stroke process forms a Stage II, which comprises taking a new coil from a coil storage by a coil transporter during stage I of the process and driving said coil to a region near an uncoiling reel, at substantially the same time removing a residual part of the rolled coil from the uncoiling reel by means of a trough working in conjunction with the coil transporter, and installing the new coil to be rolled by advancing the coil transporter with the new coil mounted thereon into the region of the uncoiling reel in preparation for threading into the rolls, and in the second process stroke, said Stage II, moving the coil transporter and the trough with the residual part of the rolled coil back toward the coil storage while the new coil is being fed into the rolling mill, and thereafter delivering the residual part of the rolled coil to a desired location.

2. Process according to claim 1 including the steps of providing the trough for removing the residual part of the coil with a jacking facility and moving said trough with said jacking facility lowered into a position below the uncoiling reel.

3. Process according to claim 2 including the steps of stopping the uncoiling reel, raising the jacking facility so that the trough supports the residual part of the rolled coil, shearing the strip remaining on the residual part of the rolled coil, removing the residual part of the rolled coil and making the space below the uncoiling reel free for a coil mounting device for delivering the new coil and for vertically positioning the new coil in a rolling position on the uncoiling reel.

4. Process according to claim 3 including the steps of moving the coil transporter and said trough along a horizontal path and synchronizing the movement of the coil transporter and the trough in terms of distance and time so that the vertical movement of the coil mounting device for vertically positioning the new coil and the vertical movement of the trough for removing the remainder of the rolled coil follow a desired sequence.

5. Process according to claim 2 wherein during the step of moving the coil transporter and trough toward the coil storage both the trough and the residual part of the rolled coil positioned thereon move beneath the level of the new coil mounted on the uncoiling reel.

6. Device for removing a residual part of a rolled coil from and for installing a new coil on a sheet or strip rolling mill, in which the new coil to be rolled is transported from a coil storage to an uncoiling reel in a two-stroke process, which comprises a roll stand, a coil transporter movable horizontally and in a shuttle-like manner in relation to the roll stand, said coil transporter being located in a mill pit so that during a first stroke of the process known as stage I the coil transporter moves from the coil storage with a new coil to the uncoiling reel, and during a second stroke of the process known as stage II the coil transporter in an empty condition moves back to the coil storage, a trough which can be raised and lowered associated with the coil transporter for receiving the residual part of the rolled coil, said trough being situated on a side of the coil transporter toward the roll stand and being moved synchronously in terms of distance and time with the coil transporter so that during said second stroke of the process the residual part of the rolled coil is delivered to a desired location as said coil transporter moves toward the coil storage while the new coil is being fed into the rolling mill.

7. Device according to claim 6 including means for moving said trough independently of the coil transporter but in synchronization therewith.

8. Device according to claim 6 including means for moving both the trough and the residual part of the rolled coil thereon during Stage II beneath the level of the new coil mounted on the uncoiling reel.

9. Device for removing a residual part of a rolled coil from and for installing a new coil on a sheet or strip rolling mill, in which the new coil to be rolled is transported from a coil storage to an uncoiling reel in a two-stroke process, which comprises a roll stand, a coil transporter movable horizontally and in a shuttle-like manner in relation to the roll stand, said coil transporter being located in a mill pit so that during a first stroke of the process known as Stage I the coil transporter moves from the coil storage with a new coil to the uncoiling reel and during a second stroke of the process known as Stage II the coil transporter in an empty condition moves back to the coil storage, a trough which can be raised and lowered for receiving the residual part of the rolled coil, said trough being mounted to a vehicle separate from the coil transporter and being moved synchronously in terms of distance and time with the coil transporter so that during the second stroke of the process the residual part of the rolled coil is delivered to a desired location as said coil transporter moves toward the coil storage.

10. Process for removing a residual part of a rolled coil from and for installing a new coil on a sheet or strip rolling mill in which the new coil to be rolled is transported in a two-stroke process and in a shuttle-like manner, wherein a first stroke of the process forms a Stage I and a second stroke of the two-stroke process forms a Stage II, which comprises taking a new coil from a coil storage by a coil transporter during Stage I of the process, driving said coil to a region near an uncoiling reel, removing a residual part of the rolled coil from the uncoiling reel by means of a trough mounted to a vehicle separate from but working in conjunction with the coil transporter, installing the new coil to be rolled by advancing the coil transporter with the new coil mounted thereon into the region of the uncoiling reel in preparation for threading into the rolls, and in the second process stroke, said Stage II, moving the coil transporter and the vehicle on which the trough is mounted back toward the coil storage so that the residual part of the rolled coil removed by the trough is delivered to a desired location and the coil transporter returns to the coil storage.

* * * * *